US005564492A

United States Patent [19]

Preiss

[11] Patent Number: 5,564,492

[45] Date of Patent: Oct. 15, 1996

[54] TITANIUM HORSESHOE

[76] Inventor: Mildred Preiss, 70 Salem Rd., Pound Ridge, N.Y. 10576

[21] Appl. No.: 309,254

[22] Filed: Sep. 20, 1994

[51] Int. Cl.[6] ..... B22C 9/04

[52] U.S. Cl. ..... 164/516; 164/34

[58] Field of Search ..... 164/34, 35, 516, 164/457

[56] References Cited

U.S. PATENT DOCUMENTS

| | | | |
|---|---|---|---|
| 3,590,905 | 7/1971 | Watts et al. | 164/165 |
| 4,316,498 | 2/1982 | Horton | 164/519 |
| 4,538,671 | 9/1985 | Waterstrat | 164/514 |
| 4,568,398 | 2/1986 | Wood et al. | 164/900 |
| 4,627,482 | 12/1986 | Waterstrat | 164/514 |
| 4,703,806 | 11/1987 | Lassow et al. | 164/518 |
| 4,787,439 | 11/1988 | Feagin | 164/518 |
| 4,947,927 | 8/1990 | Horton | 164/516 |
| 5,119,865 | 6/1992 | Mae et al. | 164/114 |
| 5,221,336 | 6/1993 | Horton | 164/518 |

*Primary Examiner*—Joseph J. Hail, III
*Assistant Examiner*—Randolph S. Herrick
*Attorney, Agent, or Firm*—Evelyn M. Sommer

[57] ABSTRACT

The present invention relates to an improved process for the preparation and fabrication of horseshoes whereby pure titanium or titanium alloys are processed with the exclusion of contaminating gases such as Oxygen, Nitrogen and Hydrogen. The titanium horseshoes have many advantages over the present state of art such as light weight, higher tensile strength, flexible, wearing resistance, abrasion resistance, hypoallergenic, workability, formability, friction-free, physiologically inert, and are easily formed and shaped into the desired configuration.

12 Claims, 2 Drawing Sheets

TITANIUM HORSESHOE

BACKGROUND OF THE INVENTION

1. Field of the Invention

This invention relates to a method for precision castings of titanium or titanium alloy applicable for obtaining precision casting of titanium or titanium alloy which have excellent heat and corrosion resistance in addition to lightness and very high strength.

2. Description of the Prior Art

INVESTMENT CASTING

If a small casting, from ½ oz to 20 lb [14 g to 9.1 kg (mass)] or today even over 100 lb (45 kg), with fine detail and accurate dimensions is needed, investment casting should be considered. This process is used to make fuel pump parts, levers, nozzles, valves, cams, medical equipment, camera parts, and many other machine and device parts. It is sometimes called the lost wax process, and it has been used for hundreds of years by jewelry makers. Some foundries refer to this process as ceramic shell casting because the metal is poured into a ceramic shell.

Any castable metal can be used, though aluminum and zinc parts can often be less expensively made by die casting. Both methods give about the same finish and accuracy, though the die-cast products may be stronger. Thus, investment casting is especially valuable for casting difficult-to-machine metals such as stainless steel, high-nickel alloys, aluminum and beryllium copper.

Investment casting is often profitable for pilot runs of as little as 21 pieces and is being used for quantities of over 100,000 parts per month. Most often the quantities ordered would be from 500 to 10,000 pieces.

However, the process is slow and is one of the most expensive casting processes. If a design is changed, it may require expensive alterations to a metal die (as it would in die casting also).

THE PATTERN

A pattern of wax or polystyrene must be made for every piece cast. The wax is made in several different grades, of beeswax, carnauba wax, paraffin, and other materials. The wax pattern may be made in steel, wood, plastic, or rubber molds. The polystyrene patterns are made by injection molding into multiple-cavity steel dies. These dies may cost from $1000 to $20,000, so they are used only if large quantities of parts of small size are to be cast.

THE TREE OR CLUSTER

The wax or plastic patterns are next fastened, by heat or adhesive, to a common feed sprue and several sprues are fastened to one base. This is a hand operation, called clustering.

INVESTING

Investing refers to the covering of the patterns with a heat-resistant slurry. Clusters for low-temperature metals, such as aluminum, can be put into a suitable size flask. Then a mixture of plaster of paris, silica, and talc, or similar materials, mixed with water is poured around the cluster. A vacuum is used to draw out the air so that plaster flows around every detail. The flask is then cured (dried) for several hours.

Shell molds for high-temperature metals, such as steel, and for large-sized castings are usually given an initial investment by dipping them several times into a slurry made from silica flour, magnesia, clay, or similar products mixed with liquid hardening agents such as ethyl alcohol, or ethyl silicate, and acid. This refractory coating is allowed to dry, and then the mold is dipped and dried several more times until a strong shell is formed.

BURNING OUT

The wax or polystyrene is now removed from the mold. This is called dewaxing or burning out the patterns. The molds are tipped upside down and heated. Some of the wax runs out and may be reused. The polystyrene is vaporized. The heat is then raised to about 1200° F. (644° C.) for aluminum and 1900° F. (1040° C.) for ferrous alloys so that the last bits of pattern material are burned out (vaporized) and the mold is at the proper temperature for pouring temperatures of up to about 2000 degrees F. may be advantageously used.

POURING THE METAL

The metal may be poured by gravity, as in sand casting. However, a vacuum is used to pull air out of the mold so that no air bubbles will remain. Centrifugal casting and pressure casting are also used.

After the metal has cooled, the molds are broken away by cracking them under a hydraulic press or by sand blasting. The individual castings are then cut off the sprue, trimmed, and chemically cleaned or tumbled as required.

CERAMIC-MOLD PROCESSES

If long-wearing, accurate castings of tool steel, cobalt alloys, titanium, stainless steel, and nonferrous alloys, including beryllium, are needed, ceramic molds are often used instead of sand molds.

The two major ceramic-molding processes are the Unicast process, licensed by Unicast Development Corporation, and the Shaw process, licensed by Avnet Shaw Division of Avnet, Inc.

Both processes use conventional patterns of ceramic wood, plastic, or metal such as steel, aluminum and copper set in cope and drag flasks. Instead of sand, a refractory slurry is used. This is made of a carefully controlled mixture of ceramic powder with a liquid catalyst binder (an alkyl silicate). Various blends are used for specific metal castings.

The ingredients are mixed just before using and are quickly poured over the pattern. In about 3 to 5 min, the slurry sets to a solid but flexible gel-like substance which can be stripped off the pattern.

In the Shaw process, the mold is set on fire, and the alcohol in the catalyst burns off. This leaves a mesh of fine cracks throughout the mold, called crazing, which makes the hard ceramic permeable so that air and gases can escape during pouring.

The Unicast process "stabilizes" the green mold by spraying or dipping it in a chemical bath. This causes a catalytic interaction which creates a cellular or spongelike permeable mold structure.

The molds are then dried, or cured, at temperatures up to 1800° F. (982° C.) for up to 1 h. They are then assembled, with cores in place, and poured in the usual manner. Castings up to 2000 lb [907 kg (mass)] have ben made, though most are from 10 to 200 lb (4.5 to 91 kg).

These ceramic molds have a coefficient of expansion of practically zero, adequate venting all over, and walls that will not bulge under pressure. Thus, very accurate castings can be made.

These processes are being used to make casting for forging dies, die-casting dies, extrusion nozzles, tire molds, some cutting tools, and many parts for machines. The accuracy of the castings is from plus or minus 0.005 in. (0.125 mm) for small castings to plus or minus 0.045 in. (1.14 mm) for castings over 15 in. (380 mm) on a side. Finishes of 75 uin (19 um) are reported as average.

Ceramic mold cast dies are finished to size by EDM or hand polishing. The materials for ceramic-mold casting are expensive, but the properties of the castings are considerably better than those of sand castings and much less machining is needed, thus, for many uses, a net saving is accomplished.

Since, the introduction of titanium and titanium alloys in the early 1950's, these materials have in a relatively short time become one of the backbone materials for the aerospace, energy, and chemical industries. The combination of high strength-to-weight ratio, excellent mechanical properties, and corrosion resistance makes titanium the best material for many critical applications. Today, titanium alloys are used for static and rotating gas turbine engine components. Some of the most critical and highly stressed civilian and military airframe parts are made of these alloys.

Net Shape technology Development. The use of titanium has expanded in recent years from applications in nuclear power plants to food processing plants, from oil refinery heat exchangers to marine components and medical prostheses. However, the high cost of titanium alloy components may limit their use to applications for which lower-cost alloys, such as aluminum and stainless steels, cannot be used. The relatively high cost is often the result of the intrinsic raw material cost of the metal, fabricating costs, and, usually most important, the metal removal costs incurred in obtaining the desired end-shape. As a result, in recent years a substantial effort has been focused on the development of net shape or near-net shape technologies to make titanium alloy components more competitive. These titanium net shape technologies include a powder metallurgy (PM), superplastic forming (SPF), precision forging, and precision casting. Precision casting is by far the most fully developed and the most widely used net shape technology.

Casting Industry Growth. The annual shipment of titanium castings increased by 240% between 1978 and 1986 and titanium casting is the fastest growing segment of titanium technology.

Even at current levels (approaching 450 Mg, or $1\times10^6$ lb, annually), castings still represent less than 2% of total titanium mill product shipments. This is in sharp contract to the ferrous and aluminum industries, where foundry output is 9% and 14% of total output, respectively. this suggests that the growth trend of titanium castings will continue as users become more aware of industry capability, suitability of cast components in a wide variety of applications, and the net shape cost advantages.

Properties Comparable to Wrought. The term castings often connotes products with properties generally inferior to wrought products. This is not true with titanium cast parts. They are generally comparable to wrought products in all respects and quite often superior. Properties associated with crack propagation and creep resistance can be superior to those of wrought products. As a result, titanium castings can be reliably substituted for forged and machined parts in many demanding applications. This is due to several unique properties of titanium alloys. One is the $\alpha+\beta$ to $\beta$ allotropic phase transformation at a temperature range of 705° to 1040° C. (1300° to 1900° F.), which is well below the solidification temperature of the alloys. As a result, the cast dendritic $\beta$ structure is wiped out during the solid state cooling stage, leading to an $\alpha+\beta$ platelet structure, which is also typical of $\beta$ processed wrought alloy. Further, the convenient allotropic transformation temperature range of most titanium alloys enables the as-cast microstructure to be improved by means of post-cast cooling rate changes and subsequent heat treatment.

Reactivity. Another unique property is the high reactivity of titanium at elevated temperatures, leading to an ease of diffusion bonding. As a result, hot isostatic pressing (HIP) of titanium casting yields components with no subsurface porosity. At the HIP temperature range 820° to 980° C., or 1500° to 1800° F. titanium dissolves any microconstituents deposited upon internal pore surfaces, leading to complete healing of casting porosity as the pores are collapsed during the pressure and heat cycle. Both the eliminating of casting porosity and the promotion of a favorable microstructure improve mechanical properties. However, the high reactivity of titanium, especially in the molten state, presents a special challenge to the foundry. Special, and sometimes relatively expensive, methods of melting, moldmaking, and surface cleaning may be required to maintain metal integrity.

HISTORICAL PERSPECTIVE OF CASTING

Although titanium is the fourth most abundant structural metal in the earth's crust (0.4 to 0.6 wt %), it has emerged only recently as a technical metal. This is the result of the high reactivity of titanium, which requires complex methods and high energy input to win the metal from the oxide ores. The required energy per ton is 1.7 times that of aluminum and 16 times that of steel. From 1930 to 1947, metallic titanium extracted from the ore as a powder or sponge form was processed into useful shapes by P/M methods to circumvent the high reactibility in the molten form.

Melting Methods: The melting of small quantities of titanium was first experimented with in 1948 using methods such as resistance heating, induction heating, and tungsten arc melting. However, these methods never developed into industrial processes.

First Castings: Shape casting of titanium was first demonstrated in the U.S. in 1954 at the U.S. Bureau of Mines using machined high-density graphite molds. The rammed graphite process developed later, also by the U.S. Bureau of Mines, lead to the production of complex shapes. This process, and its derivatives, are used today to produce parts for marine and chemical-plant components such as pump and valve components. Some aerospace components such as aircraft brake torque tubes, landing arrestor hooks, and optic housings have also been produced by this method Lost Wax Investment Molding: Lost wax investment molding was the principal technology which allowed the proliferation of casting. This method, used at the dawn of the metallurgical age for casting copper and bronze tools and ornaments, was later adapted to enable production of high-quality steel and nickel base cast parts. The adaptation of this method to titanium casting technology required the development of ceramic slurry materials having minimum reaction with the extremely reactive molten titanium.

Proprietary lost wax ceramic shell systems have been developed by the several foundries engaged in titanium casting manufacture. Of necessity, these shell systems must be relatively inert to molten titanium and cannot be made with the conventional foundry ceramics used in the ferrous and nonferrous industries. Usually, the face coats are made with special refractory oxides and appropriate binders. After the initial face coat ceramic is applied to the wax pattern, more traditional refractory systems are used to add shell strength from repeated backup ceramic coatings. Regardless of face coat composition, some metal/mold reaction inevitably occurs from titanium reduction of the ceramic oxides. The oxygen-rich surface of the casting stabilizes the α phase, usually forming a metallurgically distinct α case layer on the cast surface, which may be removed later by means of chemical milling.

Foundry practice focuses on methods to control both the extent of the metal/mold reaction and the subsequent diffusion of reaction products inward from the cast surface. Diffusion of reaction products into the cast surface is time-temperature dependent. Depth of surface contamination can vary from nil on very thin sections to more than 1.5 mm (0.06) on heavy sections. On critical aerospace structures, the brittle "α" case is removed by chemical milling. The depth of surface contamination must be taken into consideration in the initial wax pattern tool design. Hence the wax pattern temperature and thermal conductivity, "G" force (if centrifugally cast), and rapid post-cast heat removal are other key factors in producing a satisfactory product. These parameters are interrelated, that is, a high "G" force centrifugal pour into cold molds may achieve the same relative fluidity as a static pour into heated molds.

| | |
|---|---|
| MIL-T-81915 | Titanium and titanium alloy castings, investment |
| AMS-4985A | Titanium alloy castings, investment or rammed graphite |
| AMS-4991 | Titanium alloy castings, investment |
| ASTM B 367 | titanium and titanium alloy castings |

The lost wax investment process provides more design freedom for the foundry to properly feed a casting than does the traditional sand or rammed graphite approach.

Vacuum Consumable Electrode. The dominant, almost universal, method of melting titanium is with a consumable titanium electrode lowered into water-cooled copper crucibles while confined in a vacuum chamber. This skull melting technique prevents the highly reactive liquid titanium from dissolving the crucible because it is contained in a solid "skull" frozen against the water-cooled crucible wall. When an adequate melt quantity has been obtained, the residual electrode is quickly retracted, and the crucible is tilted for pouring into the molds. A "skull" of solid titanium remains in the crucible for reuse in a subsequent pour or for later removal.

Superheating. The consumable electrode practice affords little opportunity for superheating the molten pool because of the cooling effect of the water-cooled crucible. Because of limited superheating, it is common either to pour castings centrifugally, forcing the metal into the mold cavity, or to pour statically into preheated molds to obtain adequate fluidity. Postcast cooling takes place in a vacuum or in an inert gas atmosphere under controlled conditions of temperature, pressure and time and are individually variable or variable in combination until the molds can be safely removed to air without oxidation of the titanium.

Electrode Composition. Consumable titanium electrodes are either ingot metallurgy forged billet, consolidated revert wrought material, selected foundry returns, or a combination of all of these. Casting specifications or user requirements can dictate the composition of revert materials used in electrode construction.

Vacuum casting is similar to low-pressure casting, except a vacuum is created within the mold cavity and the metal is pulled rather than pushed into the mold. Excellent mechanical properties and high production rates are often realized in vacuum casting because of the low mold temperatures associated with the method. As with low pressure die casting, the metal in the fill tube acts as a riser and excellent metal yields are obtainable. The process lends itself to automation resulting in the ability to produce large quantities of high-quality castings at a competitive price. The process is usually associated with smaller castings and requires specialized complex mold designs to induce the vacuum properly.

In centrifugal casting, cylindrical or symmetrically shaped castings are poured using the centrifugal force of a spinning mold to force the metal into the mold. The sprue is located at the center of rotation. The force generated by the spinning of the mold helps the metal fill thin casting sections and maintains good contact.

WHAT IS REQUIRED FOR TITANIUM INGOT MELTING?

First one has to differentiate between what can or could be done technically—and what one is allowed to do by purchaser's specifications. This is dependent on the field of application.

The raw material of the titanium ingot is the so-called titanium sponge, which is produced in three different processes, and to a considerable percentage titanium scrap in various forms.

The conventional production route of a Ti-ingot using a compacted sponge electrode takes place by the following steps

- Analysis of sponge (for possible corrections)
- Weighing and mixing (always one lot per compact) with alloying elements and scrap (max. 45%)
- Producing compacts required in a hydraulic compacting press and storing them protected from ambient atmosphere
- Assembling, jigging and welding consumable electrode together preferably with stub in a Vacuum Plasma Welder
- Storing the welded electrode either in a desorption chamber or in a place heated well above ambient temperature in order to prevent moisture pick-up

HISTORICAL REVIEW

The birth place of Titanium Skull Melting was the Bureau of Mines in Albany, Oreg. The first casting were made in 1953, although there were possibilities already announced as early as 1948/49.

It was in the late fifties, when Heraeus High Vacuum GmbH—the nucleus company of Leybold AG—was approached by research institutes, which were looking for a practical way of liquefying uranium and pouring same into graphite molds, i.e. for producing uranium carbide.

After building a few "Skull-Melting-Devices" with an approx. crucible volume of 800 $cm^3$, which were inserts that could be used together with a laboratory vacuum arc furnace, a design was built in 1963 as a Skull Melter for the continuous production of uranium carbide. The first furnace had a crucible volume of approximately 10 liters and used a non-consumable graphite electrode to liquify the uranium pellets fed into the crucible tilting system was hydraulically driven. The molds were stationary and centrifugal casting was not utilized at that time.

Titanium and titanium alloys are light and excellent in heat as well as corrosion resistance and mechanical strength. Therefore, it is expected that useful products can be obtained by the precision casting of titanium alloy.

However, because the titanium or titanium alloy has a melting point higher than 1400 degrees Celsius and is also active, there is a problem in that there are great difficulties in melting and casting the titanium or titanium alloy in the majority of cases.

It is well known that the titanium alloys, and particularly intermetallic compositions of titanium and aluminum, have a very desirable set of properties for use at higher temperatures. Intermetallic compositions of titanium and aluminum can be employed at temperatures of 1,000 degrees Fahrenheit and higher. One of the problems associated with the use of aluminides is that they tend to be somewhat brittle at room temperatures. However, recent developments have permitted the formation of modified titanium alloys which have desirable properties at elevated temperatures but which also have significant ductility at room temperature.

Due to the fact that a very strong tendency of titanium based materials is to absorb and react with oxygen, the reprocessing of titanium or titanium alloy based materials, particularly the reprocessing of powder, can result in the material having a higher than desired oxygen content and can result in the material being out side of the required specifications for this reason.

Prior to this invention, it was known that the property of lightness in a horseshoe, particularly for use on racehorses and the like was a very desirable property. For this reason the most commonly used shoes for racehorses and the like are made of aluminum. While aluminum horseshoes afford the desired lightness, they do not exhibit particularly good wearability and strength. The average life for an aluminum horseshoe on a racehorse is approximately one month.

Numerous innovations for titanium have been provided in the prior art that are adapted to the specific purpose for which the titanium is to be used. Even though these innovations may be suitable for the specific individual purposes which they address, they would not be suitable for the purposes of the present invention as heretofore described.

SUMMARY OF THE INVENTION

Accordingly, it is an object of the present invention to provide an improved titanium horseshoe.

More particularly, it is an object of the present invention to provide an improved titanium horseshoe that avoids the disadvantages of the prior art.

Accordingly it is an object of this invention to provide a cost efficient horseshoe made from titanium.

It is a further object of this invention to produce a horseshoe with an absolutely minimum waste of material as may be easily accomplished by using casting technology.

Another object of this instant invention is to eliminate expensive tooling as is the case herein.

A still further object of the instant invention, and a most important object, is to produce a horseshoe that is extremely malleable so that it easily conforms to the natural contour of a horse's hoof, said hoof being generally but not completely or perfectly flat and the prior art can not approach the aforementioned advantage of the instant invention.

Another object of the instant invention is to provide a titanium horseshoe that is consistent and uniform in shape, strength and other important properties required for horseshoes.

A still further object of the instant invention is to provide a light weight horseshoes that is as light as aluminum and as strong as steel.

An object of this invention is to provide an improved horseshoe which affords the same desirable property of lightness as aluminum but has improved wearability and strength.

It is, accordingly, one object of the present invention to provide a method by which the composition of titanium or titanium alloy based materials may be modified during manufacture to yield products having a desired combination of properties.

Another object is to provide a method of altering the ratio of the ingredients of the titanium alloy during the horseshoe manufacturing process prior to removal of contaminating gases.

Another object is to provide a method of producing horseshoes having a superior set of properties.

The invention relates to the material and process of fabricating horseshoes out of titanium metal or titanium composites and specifically the invention relates to fabricating horseshoes by a molten metal casting process effective for removing contaminating gases such as oxygen, nitrogen and hydrogen. The contaminating gases can be removed by replacement with an inert gas or by use of a chelating substance effective to bind the contaminating gas or gases.

This manufacturing technique for titanium horseshoes is carried out with the removal of oxygen, nitrogen, and hydrogen so as to warrant high quality standards and improved horseshoe products.

Importantly, prior to the invention steel and aluminum were used extensively in manufacturing horeshoes, their drawbacks being their excessive weight, low strength and galvancy and corrosive allergic reactivity to the hoof tissue in the stable and field environment.

This invention is directed to solving the above-mentioned problems of the prior art by a process which makes it possible to obtain precision castings of titanium or titanium alloys having high melting points or high activity by preventing the molten metal from contamination by gases such as oxygen, nitrogen and hydrogen during manufacture, thus, maintaining the quality and the temperature of the molten metal required for the casting, and casting the molten metal under casting conditions suitable to prevent contamination of the molten metal even if the molten metal is cast at a low temperature at the time of carrying out the precision casting of titanium or titanium alloys having high melting points or high activities due to the presence of tungsten, molybdenum, vanadium, zirconium, lithium or the like.

The method for precision casting of titanium or titanium alloy according to this invention for attaining the above-mentioned objects is characterized by the steps of establishing molten base metal of titanium or titanium alloy by induction heating in an assembly. In preferred aspects according to this invention, the base metal may be melted in an atmosphere of an inert gas or other means of removal of contaminating gases such as oxygen, nitrogen and hydrogen.

The construction of the precision casting apparatus for titanium or titanium alloy according to this invention is characterized by providing for heating metal of titanium or titanium alloy and a permeable mold for casting the base metal molten including induction heating and removal of contaminating gases by means of vacuum casting.

The invention may be applied to all types of horseshoes, including for example, shoes used for training, racing and jumping. In general, horseshoes made according to the invention will differ in composition shape and configuration from ordinary horseshoes by virtue of the characteristic relationship of the titanium or titanium alloy between its strength, weight, and other favorable properties.

Cold working the horseshoe may be necessary when fitting the horseshoe to a horse's hoof for a perfect fit and it may also be necessary to heat the horseshoe slightly to assist this fitting. Once in place on the horse's hoof, the normal action of the hoof on the ground as the horse moves will continue cold working, thus strengthening the horseshoe.

The instant invention consists of the construction of horseshoes from titanium which may be of the type which has been disclosed and successfully perfected in my previous patent and it is the primary object of the instant invention to set forth a new and unique process whereby horseshoes may be successfully made by using titanium or titanium alloys including removing contaminating gases during manufacture.

Accordingly the horeshoe of the instant invention has the desirable features of:

a. lightweight b. high strength c. flexibility d. excellent wearing qualities e. abrasion resistance f. workability g. formability h. reduced friction i. hypo allergenic j. physiologically inert Further objects of the instant invention of titanium horseshoes will become apparent hereinafter.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

Figure 1:
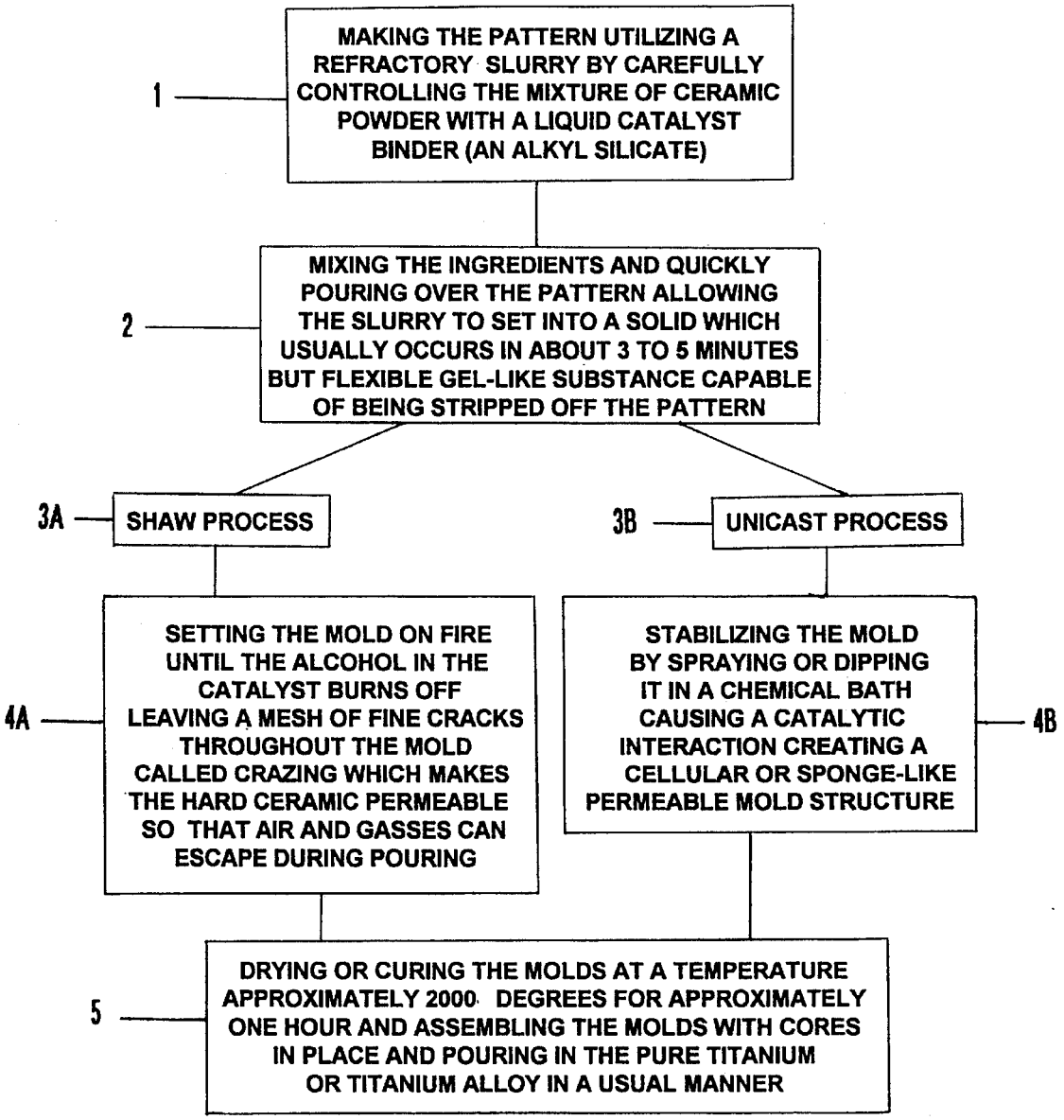
FIG. 1 is a schematic diagrammatic flow chart of investment casting illustrating the manufacture of titanium horseshoes specifically pointing out the removal of nitrogen, oxygen and hydrogen which improves the intrinsic properties of the product.

One embodiment of the process of the invention is illustrated in the flow chart depicted in FIG. 1. The numbering of the steps in the process described in FIG. 1 and FIG. 2 as well correspond to the reference numerals shown in the drawings.

INVESTMENT CASTING

1—making the pattern utilizing a refractory slurry while carefully controlling the mixture of ceramic powder with a liquid catalyst binder(an alkyl silicate)

2—mixing the ingredients and quickly pouring the pattern and allowing the slurry to set into a solid but flexible gel-like substance capable of being stripped off the pattern which usually occurs in about 3 to 5 minutes 3A—Shaw process 3B—Unicast process 4A—setting the mold on fire until the alcohol present in the catalyst burns off leaving a mesh of fine cracks throughout the mold called crazing which makes the hard ceramic permeable so that air and gases can escape during pouring 4B—stabilizing the mold by spraying or dipping it in a chemical bath causing a catalytic interaction creating a cellular or sponge-like permeable mold structure 5—drying or curing the molds at a temperature approximately 2000 degrees F. for approximately one hour and assembling the molds with cores in place and pouring in the pure titanium or titanium alloy in a usual manner

CERAMIC MOLD CASTING

6—making the wax or polystyrene pattern by injection molding into multiple-cavity steel and/or aluminum dies 7—clustering the pattern by fastening the wax or polystyrene pattern by heating or adhesive means to a common feed sprue and fastening several sprues onto one base 8—investing the patterns by covering the patterns with a heat resistant slurry and vacuuming out the air so that the slurry flows evenly around every detail and curing(drying) the patterns for several hours the investing process is repeated several times until a strong shell is formed 9—burning out(dewaxing) the patterns by tipping upside down and heating to approximately 2000 degrees until the wax runs out or the polystyrene is vaporized 10—pouring the pure titanium or titanium alloy into the mold utilizing a vacuum to pull out all of the air contained within so that no air bubbles will remain, centrifugal and pressure casting may also be used

INVESTMENT AND CERAMIC MOLD CASTING cooling and removal of formed horseshoe from cavity titanium or titanium alloy horseshoe with improved intrinsic properties

DETAILED DESCRIPTION OF THE PREFERRED EMBODIMENTS

A preferred embodiment of the invention comprises manufacturing process of investment casting resulting in an improved horseshoe as is shown in FIG. 1 of the drawing and said horseshoe is constructed of titanium or titanium alloy. The manufacturing process is as follows:

a) making the pattern utilizing a refractory slurry by carefully controlling the mixture of ceramic powder with a liquid catalyst binder(an alkyl silicate);

b) mixing the ingredients and quickly pouring the pattern allowing the slurry to set into a solid but flexible gel-like substance capable of being stripped off the pattern which usually occurs in about 3 to 5 minutes The process can then proceed according to one of two methods which are the Shaw process and the Unicast process consisting of;

c) setting the mold on fire in the Shaw process until the alcohol in the catalyst burns off leaving a mesh of fine cracks throughout the mold called crazing which makes the hard ceramic permeable so that air and gases can escape during pouring;

d) stabilizing the mold in the Unicast process by spraying or dipping it in a chemical bath causing a catalytic interaction creating a cellular or sponge-like permeable mold structure;

e) drying or curing the molds in both the Shaw and Unicast processes at a temperature approximately 2000 degrees F. for approximately one hour and assembling the molds with cores in place and pouring in the pure titanium or titanium alloy in the usual manner.

Figure 2:
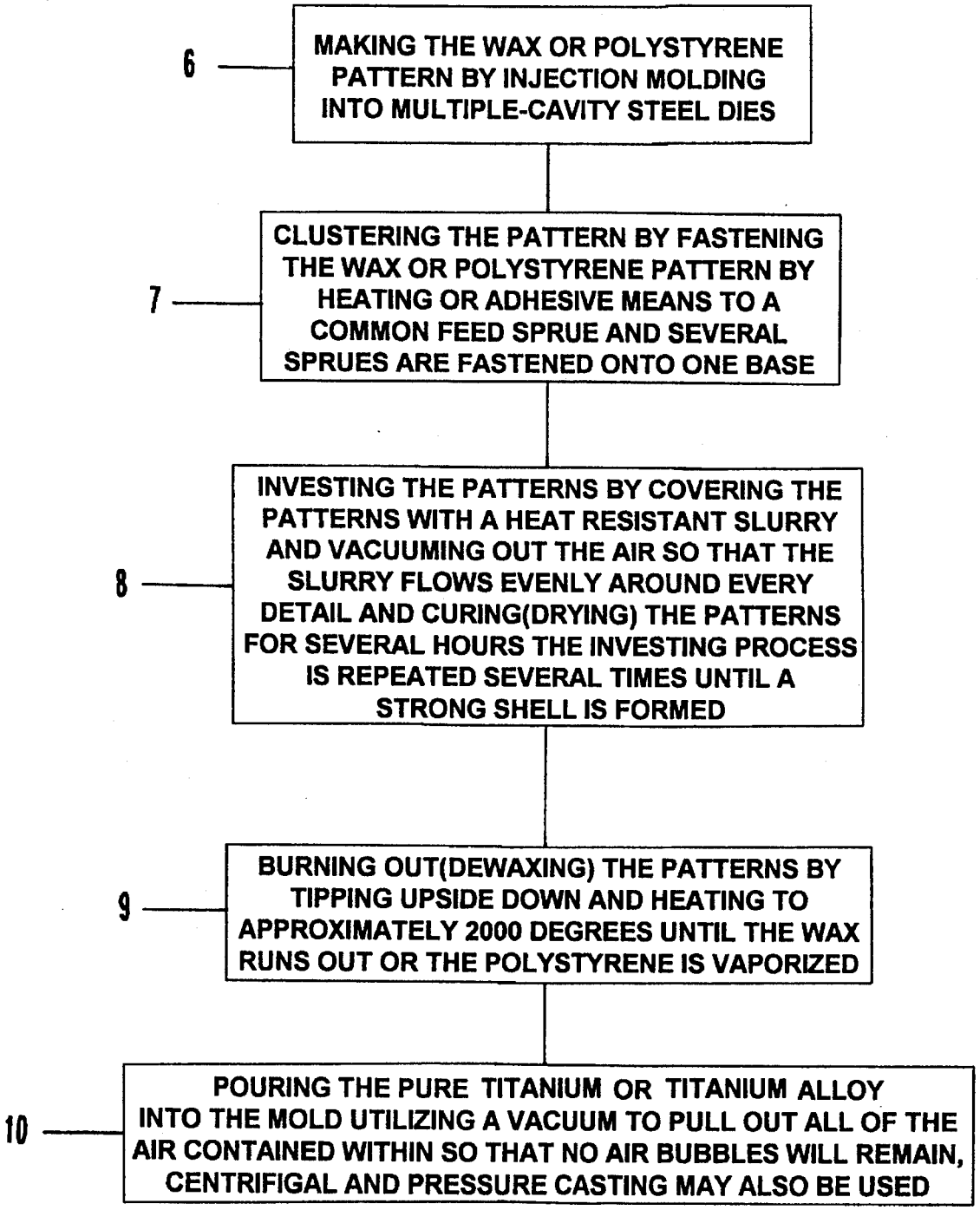
FIG. 2 is a schematic diagrammatic flow chart of ceramic mold casting illustrating the manufacture of titanium horseshoes specifically pointing out the removal of nitrogen, oxygen and hydrogen which improves the intrinsic properties of the product.

In accordance with another preferred embodiment of the invention, the manufacturing process comprises ceramic casting as shown in FIG. 2 of the drawing, resulting in an improved horseshoe constructed of pure titanium or titanium alloy. The manufacturing process is as follows:

a) making the wax or polystyrene pattern by injection molding into multiple-cavity steel dies;

b) clustering the pattern by fastening the wax or polystyrene pattern by heating or adhesive means to a common feed sprue and several sprues are fastened onto one base;

d) investing the patterns by covering the patterns with a heat resistant slurry and vacuuming out the air so that the slurry flows evenly around every detail and curing(drying) the patterns for several hours. The investing process can be repeated several times until a strong shell is formed;

e) burning out(dewaxing) the patterns by tipping upside down and heating to approximately 2000 degrees F. until the wax runs out or the polystyrene is vaporized;

f) pouring the pure titanium or titanium alloy into the mold utilizing a vacuum to pull out all of the air contained within so that no air bubbles will remain, centrifugal and pressure casting may also be used;

g) cooling and removal of formed horseshoe from cavity;

h) titanium or titanium alloy horseshoe with improved intrinsic properties.

While the invention has been illustrated and described as embodied in an improved titanium horseshoe, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for fabricating horseshoes of a desired configuration from titanium by casting, comprising the steps of a) making a wax or polystyrene pattern by injecting wax or polystyrene into a die having the desired horseshoe configuration and formed from a heat resistant material selected from the group consisting of ceramic, steel, aluminum and copper;

b) investing said pattern by covering it with a ceramic heat resistant slurry, drying the resultant ceramic coated pattern for several hours and repeating this step b) at least one more time;

c) removing the wax or polystyrene pattern by tipping upside down and heating to a temperature at which the wax melts and runs out or the polystyrene is vaporized to form a mold of heat resistant material shaped to the desired configuration;

d) introducing a casting material selected from the group consisting of substantially gas-free molten substantially pure titanium and molten titanium alloy into a cavity in said mold while utilizing a vacuum to remove any air or other gases which may be present and wherein additionally any air or gases present in said molten metal casting material are removed by introducing a chelating substance into said molten casting material which chelating substance is effective to bind said air or gases; and e) cooling said mold containing the casting formed from said titanium casting material and removing the cast horseshoe from the cavity of said mold.

2. A process for fabricating horseshoes of a desired configuration from titanium by casting comprising the steps of:

a) making a wax or polystyrene pattern by injecting wax or polystyrene into multiple cavity dies having the desired horseshoe configuration and formed from a heat resistant casting material selected from the group consisting of ceramic, steel, aluminum or copper;

b) clustering the patterns by fastening several of the wax or polystyrene patterns to a common feed sprue and thereafter fastening several sprues onto one base;

c) preparing a slurry of a ceramic powder and a liquid catalyst binder;

d) covering the patterns with said ceramic slurry and allowing the slurry to solidify;

e) removing the wax or polystyrene patterns by tipping upsidedown and heating to a temperature at which the wax melts and runs out or the polystyrene is vaporized;

f) heating the resultant ceramic coated patterns to a temperature effective to evaporate any slurry liquid present and to form a crazed gas permeable mold;

g) introducing a casting material selected from the group consisting of molten substantially gas-free pure titanium and molten titanium alloy into a cavity in said mold while utilizing a vacuum to remove any air or other gases which may be present and wherein additionally any air or gases present in said molten metal casting material are removed by introducing a chelating substance into said molten casting material which chelating substance is effective to bind said air or gases; and h) cooling said molds containing the casting and removing the formed horseshoes from the cavity of said molds.

3. A process for fabricating horseshoes from titanium according to claim 2 comprising the additional step of: treating the patterns formed in step f) with a chemical treatment solution whereby a catalytic reaction occurs to provide a gas permeable mold.

4. A process for fabricating horseshoes of a desired configuration from titanium by casting, comprising the steps of a) making a plurality of wax or polystyrene patterns by injecting wax or polystyrene into multiple cavity dies having the desired horseshoe configuration and formed from a heat resistant material which is selected from a group consisting of ceramic, steel, aluminum and copper;

b) clustering the wax or polystyrene patterns by fastening several of the wax or polystyrene patterns to a common feed sprue and thereafter fastening several sprues onto one base;

c) investing said patterns by covering them with a ceramic heat resistant slurry, drying the resultant ceramic coated patterns for several hours and repeating this step c) at least one more time;

d) removing the wax or polystyrene patterns by tipping upside down and heating to a temperature at which the wax melts and runs out or the polystyrene is vaporized to form molds of heat resistant material shaped to the desired configuration;

e) introducing a casting material selected from the group consisting of substantially gas-free molten substantially pure titanium and molten titanium alloy into said mold in a manner effective to form a casting while utilizing a vacuum to remove any air or other gases which may be present and wherein additionally any air or gases present in said molten metal casting material are removed by introducing a chelating substance into said molten casting material which chelating substance is effective to bind said air or gases; and f) cooling said molds containing the castings formed from said casting material and removing the castings from the cavity of said molds.

5. Process according to claim 4 wherein said substantially gas-free molten titanium of step e was made substantially gas-free by the further step of introducing an inert gas into said molten titanium in a manner effective to make said molten titanium substantially gas-free.

6. Process according to claim 5 wherein said gases are at least one member selected from the group consisting of oxygen, nitrogen and hydrogen.

7. Process according to claim 4 wherein substantially pure titanium is used in said step of introducing a casting material selected from the group consisting of substantially gas-free molten substantially pure titanium and molten titanium ahoy into said mold.

8. Process according to claim 4 wherein titanium alloy is used in said step of introducing a casting material selected from the group consisting of substantially gas-free molten substantially pure titanium and molten titanium alloy into said mold and said titanium alloy contains in addition to titanium at least one member selected from the group consisting of steel, copper, aluminum, tungsten, molybdenum, vanadium and lithium wherein said alloy is heat and corrosion resistance, and lightness with a very high strength.

9. Process according to claim 4 wherein said step of introducing a casting material selected from the group consisting of substantially gas-free molten substantially pure titanium and molten titanium alloy into said mold comprises centrifugal casting.

10. Process according to claim 4 wherein said step of introducing a casting material selected from the group consisting of substantially gas-free molten substantially pure titanium and molten titanium alloy into said mold comprises pressure casting.

11. Process according to claim 4 wherein said heating in step d) is carried out at a temperature of approximately 2000 degrees F.

12. Process according to claim 11 wherein said cooling in step f) is to room temperature.

* * * * *